United States Patent [19]

Guthrie et al.

[11] 4,277,282

[45] Jul. 7, 1981

[54] METHOD OF MELT DISPERSING A FLOATABLE SOLID ADDITIVE IN MOLTEN METAL AND A MELT DISPERSIBLE, FLOATABLE, SOLID ADDITIVE THEREFOR

[75] Inventors: Roderick I. L. Guthrie, 35 Windsor Ave., Westmount, Quebec; Frank Mucciardi, Montreal, both of Canada

[73] Assignee: Roderick I. L. Guthrie, Westmount, Canada

[21] Appl. No.: 132,972

[22] Filed: Mar. 24, 1980

[51] Int. Cl.[3] ..... C22B 9/10; C21C 7/00

[52] U.S. Cl. ..... 75/53; 75/93 G

[58] Field of Search ..... 75/53, 93 G

[56] References Cited

U.S. PATENT DOCUMENTS 3,865,577 2/1975 Gottschol ..... 75/53

4,060,407 11/1977 Jackman ..... 75/53

4,083,716 4/1978 Yoshida ..... 75/53

*Primary Examiner*—P. D. Rosenberg

*Attorney, Agent, or Firm*—Stanley J. Rogers

[57] ABSTRACT

A melt dispersible, floatable, solid additive for molten metal comprises an elongated body of the additive with a band or bands of a thermal barrier providing material therearound which is preferably heat decomposable and gas evolving at the temperature of the molten metal. When the additive is dropped or released and urged forcibly into the molten metal the formation of a solid casing of the molten metal on the body at the position of the band or bands is retarded so that melted additive is released at the position of the band or bands and the body separates into discrete parts thereby rapidly releasing the additive into the molten metal.

12 Claims, 5 Drawing Figures

Figure 1:
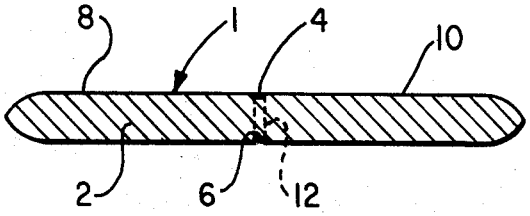

METHOD OF MELT DISPERSING A FLOATABLE SOLID ADDITIVE IN MOLTEN METAL AND A MELT DISPERSIBLE, FLOATABLE, SOLID ADDITIVE THEREFOR

This invention relates to a method of melt dispersing a floatable, solid additive in molten metal and a melt dispersible, floatable, solid additive therefor.

It has already been proposed in U.S. Pat. Nos. 1,915,824, dated June 27, 1933, C. Hardy and D. M. Scott, and 3,917,240, dated Nov. 4, 1975, T. Tanoue, T. Araki and T. Aoki, to project a solid charge of metal, of lower specific gravity, at a high velocity into a bath of molten metal. The charge is of a metal of lower specific gravity than that of the molten metal and so the charge is projected with sufficient force to cause the charge to penetrate deeply below the surface of the metal bath.

The solid charge of metal is caused to penetrate deeply below the surface of the metal bath to avoid the solid charge resurfacing too quickly and:

(a) when a reactive refining agent charge is used, the charge collecting at the surface and reacting mainly with molten metal or slag at the surface, (b) when a highly reactive refining agent charge is used, the charge collecting at the surface and reacting with the surrounding atmosphere, and (c) when an alloying constituent or constituents charge is used, the charge collecting at the surface so that the alloying activity takes place at the surface instead of substantially throughout the entire body of the molten metal.

While this method of treating molten metal has proved to be useful, a problem still exists in that the charge generally becomes coated with a solidified shell of metal from the metal bath and this solidified shell delays dissolution of the charge into the metal bath for a sufficient length of time for the charge to resurface in stagnant ladles before complete dissolution and, if reactive, reaction has occurred. This problem is discussed in detail in "An experimental and mathematical evaluation of shooting methods for projecting buoyant alloy additions into liquid steel baths," R. I. L. Guthrie, L. Gourtsoyannis and H. Henein, Canadian Metallurgy Quarterly, Volume 15, No. 2 (1976), pages 1 to 9.

It would be desirable to provide a method of introducing metal additions into molten metal baths wherein any delay in dissolution of the charge into the molten metal due to a solid shell forming around the charge is reduced.

According to the present invention there is provided a melt dispersible, floatable, solid additive for molten metal, comprising:

(a) a solid, elongated body of the additive and (b) a thermal barrier providing material fastened on at least one intermediate surface area portion of the solid body with the remaining surface area of the solid body exposed for direct contact with the molten metal.

Further, according to the present invention there is provided a method of melt dispersing a floatable, solid additive in molten metal, comprising:

(a) submerging a solid body of the additive deeply in the molten metal for a sufficient length of time to melt and disperse the solid body, and wherein the improvement comprises:

(b) fastening on at least one intermediate surface area portion of the solid body a thermal barrier providing material, with the remaining surface area of the solid body exposed for direct contact with the molten metal, whereby (c) formation of a solidified casing of the molten metal on the portion of the solid body covered by the thermal barrier providing material is retarded and melted additive from the solid body will leak into the molten metal at the position of the thermal barrier providing material causing the solid body to separate into discrete parts.

In some embodiments of the present invention the thermal barrier providing material is heat decompasable at the temperature of the molten metal.

In other embodiments of the present invention the thermal barrier providing material is of a heat decomposable material that is gas evolving on exposure to the molten metal.

In yet further embodiments of the present invention the thermal barrier providing material is in a slot in the solid, elongated body.

Figure 5:
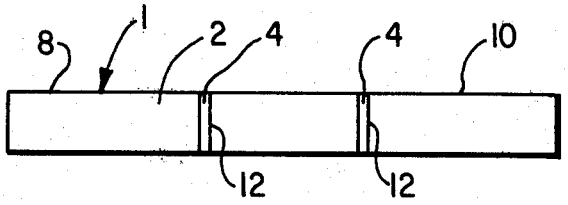
Figure 2:
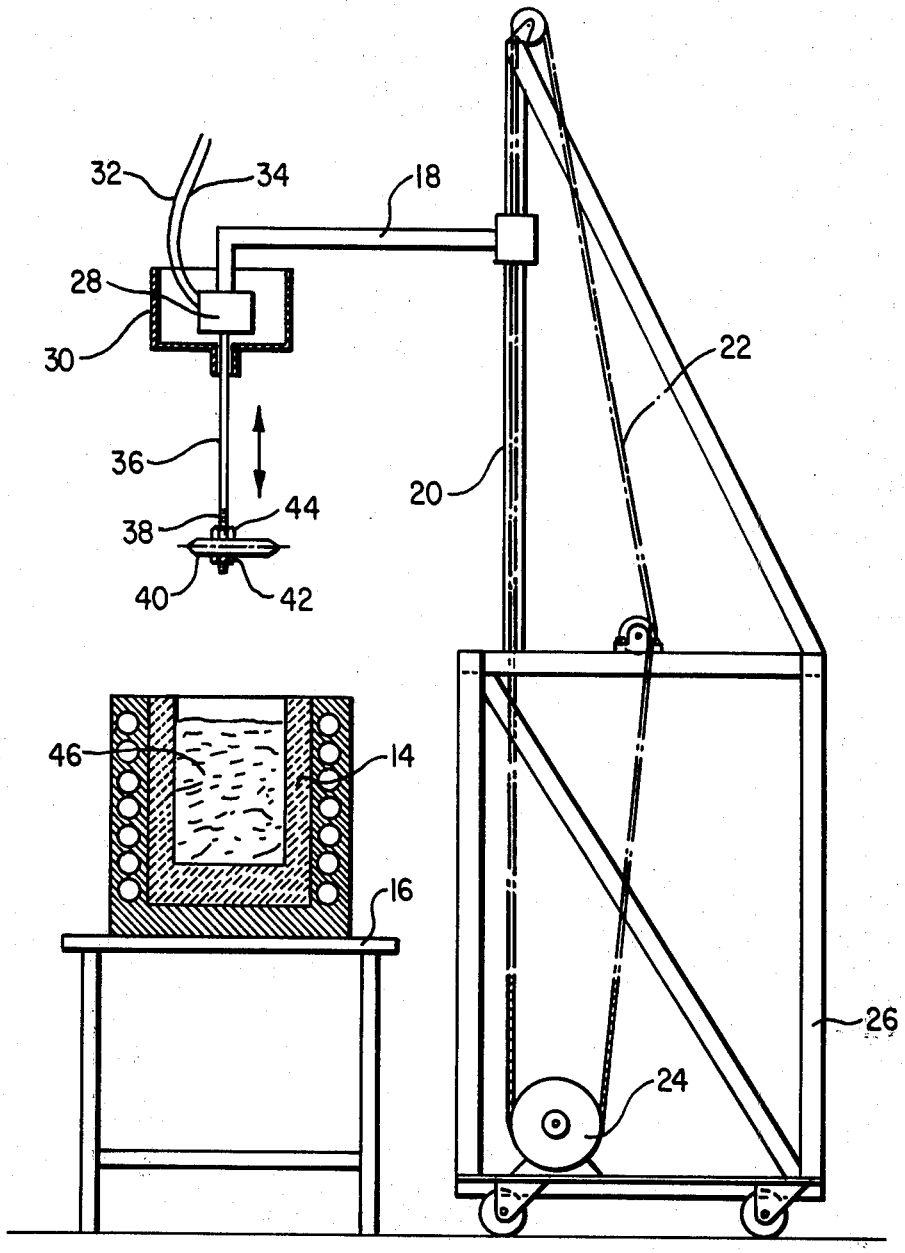
Figure 3:
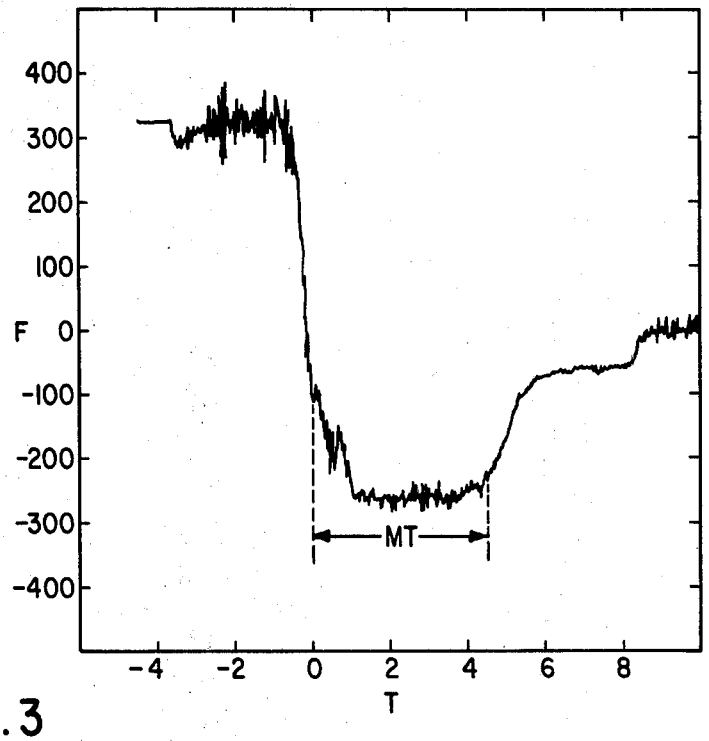
Figure 4:
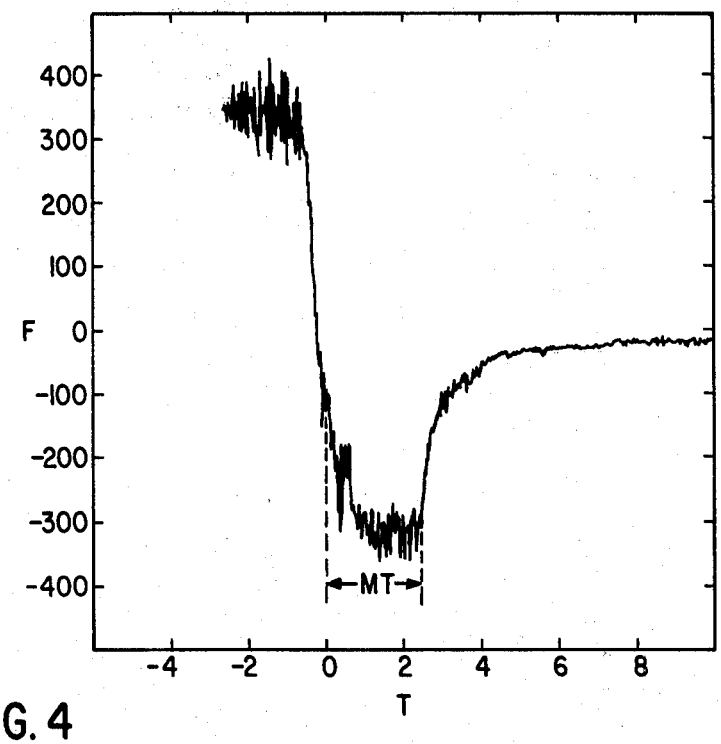

In the accompanying drawings which illustrate, by way of example, a test apparatus and embodiments of the present invention, FIG. 1 is a sectional side view through the centre-line of a melt dispersible, floatable, solid additive for molten steel, FIG. 2 is a schematic side view of an apparatus that has been used to carry out tests to verify the present invention, FIG. 3 is a graph of a conventional additive showing the rate at which the additive melted, FIG. 4 is a graph of an additive according to the present invention showing the rate at which the additive melted, and FIG. 5 is a side view of a different melt dispersible, floatable, solid additive to that shown in FIG. 1.

In FIG. 1, there is shown a melt dispersible, floatable, solid additive, generally designated 1, for molten steel, comprising:

(a) a solid, elongated body 2 of the additive, and (b) a band of thermal barrier providing material 4, which is preferably heat decomposable and gas evolving at the temperature of the molten steel, fastened on an intermediate surface area portion 6 of the solid body 2 with the remaining surface area, in this embodiment surface areas 8 and 10, of the solid body 2 exposed for direct contact with the molten steel.

In operation, the body 2 is immersed in molten steel and a solidified casing of the molten metal forms on the surface area portions 8 and 10 while the formation of such a casing at the band 4 is retarded so that melted additive of the body 2 will leak from the body 2 at the position of the band 4 causing the body 2 to separate into discrete parts.

In this embodiment, the thermal barrier providing material is in the form of a band in the slot 12 and, as previously stated, is preferably of a heat decomposable material that is gas evolving, for example, combustible, or volatile, on exposure to the molten steel to provide a thermal insulating gas film around the intermediate surface area portion 6 of the solid body 2. Tests using the apparatus shown in FIG. 2 have shown that when the solid body 2 is of aluminum and the molten metal is steel the gas film preferably provides a thermal resistance greater than 100cals.$^{-1}$, cm$^2$, °C. second for a 2 cm. diameter and 15.2 cm. length solid body 2, of the type shown in FIG. 1, until the portions of the solid body 2 within the surface areas 8 and 10 have melted and separated into discrete parts.

Referring now to FIG. 2, there is shown an apparatus that was used to carry out tests to verify the present invention. An induction heated crucible 14 was mounted on a platform 16. An arm 18 was slidable vertically on a rail 20 by means of a chain 22 and ¾ H.P. electric motor drive 24. The electric motor 24, chain 22 and rail 20 were mounted on a trolley 26. The arm 18 had a load cell 28 depending therefrom. The load cell 28 was shielded by a heat shield 30 and was connected by electrical cables 32 and 34 to a recorder (not shown). A support rod 36 was rigidly attached to the load cell 28 and extended downwardly therefrom. The lower end 38 of the support rod 36 was screw threaded so that a melt dispersible, floatable, solid additive 40, having a hole drilled therethrough, could be clamped on the support rod 36 by two screw threaded nuts 42 and 44.

The apparatus shown in FIG. 2 was used to horizontally submerge and hold horizontally submerged aluminum, melt dispersible, floatable, solid additives 40 in 200 lb. (90.7 kg.) of induction heated molten steel 46 and record by means of the load cell 28 the weight changes of the additive 40 against immersion time in terms of the downthrust necessary to hold the additive 40 submerged in the molten steel 46.

Table 1 lists the results of the tests and in the experiments designated * bullet shaped additives were used while in all of the other tests right cylinder additives were used. All of the additives used were 6061–T6 aluminum (98% Al). In the experiments designated A, a right cylinder additive was only barely immersed below the surface of the molten steel 46. In the experiments designated B, a thermal barrier providing material 4 (FIG. 1) comprising ⅝ inches (15.9 m.m) wide Saran Wrap (Trade Mark) was used. In the experiments wherein the thermal barrier providing material 4 is designated cement this comprised of Kyanex (Trade Mark) refractory cement available from Canadian Refractories. In the experiments wherein the thermal barrier providing material 4 is designated tape this comprised yellow masking tape (0.14 m.m thick) available from D. R. G. Sellotape.

TABLE 1

| EXPERIMENT NUMBER | TEST NUMBER | ANNULAR GROOVE SIZE IN ADDITIVE (width × depth) | THERMAL BARRIER PROVIDING MATERIAL AROUND ADDITIVE (# LAYERS) | MOLTEN STEEL TEMPERATURE (°C.) | TIME TO START OF RELEASE OF ADDITIVE (seconds) | TOTAL RELEASE TIME OF ADDITIVE (seconds) |
|---|---|---|---|---|---|---|
| 1 | 1 | None | None | 1574 | 3.8 | 0.8 |
| 1 | 5 | None | None | 1576 | 3.5 | 1.1 |
| 2 A | 2 | None | None | 1552 | 4.1 | 1.8 |
| 2 | 5 | None | None | 1552 | 4.6 | 1.8 |
| 3 | 1 | None | None | 1550 | 4.4 | 1.2 |
| 3* | 6 | None | None | 1548 | 4.8 | 1.8 |
| 4 | 1 | None | None | 1548 | 4.4 | 0.8 |
| 1 B | 8 | None | Wrap (14) | 1577 | 3.5 | 0.9 |
| 1 B | 9 | None | Wrap (21) | 1578 | 3.4 | N.A. |
| 2 B | 6 | None | Wrap (21) | 1552 | 4.8 | 0.9 |
| 1 | 2 | 12.7 mm × 3.2 mm | Cement (1) | 1574 | 3.2 | 1.5 |
| 2 | 8 | 12.7 mm × 3.2 mm | Cement (1) | 1551 | 3.8 | 1.4 |
| 1 | 4 | 12.7 mm × 1.6 mm | Cement (1) | 1572 | 2.4 | 1.2 |
| 2 | 7 | 12.7 mm × 1.6 mm | Cement (1) | 1549 | 5.1 | 0.7 + 2.1 |
| 3* | 5 | 12.7 mm × 1.6 mm | Cement (1) | 1550 | 3.9 | 0.7 |
| 3* | 2 | 12.7 mm × 1.6 mm | Tape (11) | 1548 | 3.1 | 1.5 |
| 4 | 3 | 12.7 mm × 1.6 mm | Tape (11) | 1546 | 3.3 | 1.5 |
| 1 | 6 | 6.4 mm × 3.2 mm | Cement (1) | 1578 | 3.2 | 0.6 |
| 2 | 4 | 6.4 mm × 3.2 mm | Cement (1) | 1551 | 2.7 | 0.4 + 1.2 |
| 3* | 4 | 6.4 mm × 3.2 mm | Cement (1) | 1547 | 4.4 | 0.7 |
| 1 | 7 | 6.4 mm × 1.6 mm | Cement (1) | 1578 | 3.5 | 1.0 |
| 2 | 3 | 6.4 mm × 1.6 mm | Cement (1) | 1552 | 3.4 | 1.3 |
| 3* | 7 | 6.4 mm × 1.6 mm | Cement (1) | 1550 | 4.0 | 0.7 |
| 3* | 3 | 6.4 mm × 1.6 mm | Tape (11) | 1544 | 2.3 | 0.3 + 1.0 |
| 4 | 2 | 6.4 mm × 1.6 mm | Tape (11) | 1550 | 2.2 | 0.3 + 1.1 |

The results for Experiment No. 3, Test No. 1, show that a conventional additive melted in a melting time MI of 4.4 seconds, and the results of this test are illustrated in the graph of FIG. 3 wherein the net downward force F in grams, measured by the load cell 28 (FIG. 2) is plotted against the additive immersion time T seconds in the molten steel 46.

The results of Experiment No. 3, Test No. 3, show that an additive according to the present invention with a 6.4 m.m. wide × 1.6 m.m. thick masking tape (11 layers) in an annular groove of these dimensions split in half, releasing its molten contents in a melting time MT of 2.3 seconds and the results of this test are illustrated in the graph of FIG. 4 wherein the downward force F grams is again plotted against the immersion time T seconds.

Thus the FIGS. 3 and 4 illustrate the considerable reduction in melting time achieved by using additives according to the present invention.

The experiments carried out have shown that:

(i) the additives according to the present invention may merely be dropped, or released and urged forcibly, into the molten metal, (ii) the pointed ends of a bullet shaped additive or corners of a right cylinder shaped additive melt and are released more rapidly than the main body of the additive and so other shapes such as, for example, a starfish shaped additive with bands of the thermal barrier providing material around intermediate portions of the radiating, pointed arms could also be used in addition to the shapes used in the tests, and (iii) any typical industrial superheat in the molten metal (e.g. 0°–100° C. for steel) is not important with regard to an additive according to the present invention because the heat for melting the additive is predominantly derived from the latent heat of a solidified shell of the molten metal that forms around the additive rather than from heat transferred from the molten metal to the solidified shell. Therefore, since no shell forms over the bands 4, the time at which the molten additive is released is practically constant irrespective of the thickness of the bath shell. In contrast, for conventional additives a halving of the superheat, e.g. from 40° C. to 20° C. will roughly double the time when the molten additive is released from its encasing bath shell.

In FIG. 5 similar parts to those shown in FIG. 1 are designated by the same references and the previous description is relied upon to describe them.

In the embodiment shown in FIG. 5 the additive is shaped as a right cylinder and two bands 4 are provided in two slots 12 with an intermediate surface area 7 between them.

The embodiment shown in FIG. 5 functions in a similar manner to the embodiment shown in FIG. 1 except that molten additive will leak from the body 2 at the positions of both of the bands 4.

Other additive materials from which the bodies 2 may be made are, for example, calcium or magnesium or other metal additives than aluminum. A list of some possible refining agents to which fast-melting bullets can potentially be applied is given in the following Table 2.

The bands 4 may be made, for example, from paper, masking tape or Saran Wrap (Trade Mark).

(5) Thermally insulating or heat decomposable inorganics (e.g. $NaNO_3$, $MgCO_3$, $CaCO_3$, etc.)

(6) Other thermally insulating materials (e.g. wood, cork, glass, etc.)

A particularly good material for the bands 4 is polyethylene laminated to woven cloth tape, 6.4 mm wide×1.6 mm thick, marketed under the trade name "920To Dominion Tape" obtainable from Dominion Tape Limited, Cornwall, Ontario, Canada. For a 25.4 mm diameter bullet shaped body 3 to 4 turns of this tape have been used successfully but the preferred number of turns varies (increases) for larger diameter bullet shaped bodies.

The applicants have found that it is preferred not to use bands 4 of greater width than 6.4 mm because this spreads the evolving thermal insulating effect over too large an area as a result of the evolving gas bubbles spreading over a larger surface area than the band 4, and retards melting of the body 2 in that locality, and so if more thermal insulation is desired it is preferable to use a band 4 of greater thickness.

A body 2 having a bullet shaped leading end is preferred for ease of penetration of the metal bath and because it reduces splashing of the molten metal. The reason for using a body 2 which is bullet-shaped at both ends is that an operator does not have to be concerned about which end is intended to be the leading end when loading the body 2 into an apparatus for projecting the body 2 into a bath of molten metal.

We claim:

TABLE 2

TYPICAL LIST OF POSSIBLE REFINING AGENTS TO WHICH THE PRESENT INVENTION CAN BE APPLIED

| REFINING MATERIAL IN BULLET | LIQUID METAL BATH | PURPOSE | MELTING RANGE OF ADDITION (°C.) | SPECIFIC GRAVITY OF SOLID WITH RESPECT TO BATH ($P_S/P_{BATH}$) | THERMAL CONDUCTIVITY OF SOLID ADDITION (cal . cm$^{-1}$ . °C.$^{-1}$ . S$^{-1}$) |
|---|---|---|---|---|---|
| Aluminum | Steel | Deoxidation, Grain Refining | 660 | 0.39 | 0.53 |
| Calcium | Steel | Desulphurisation, Inclusion Control | 840 | 0.22 | 0.30 |
| Magnesium | Iron ('Hot Metal') or Foundry Grades | Desulphurisation, Nodularisation | 650 | 0.25 | 0.38 |
| Magnesium | Steel | Desulphurisation | 650 | 0.25 | 0.38 |
| Mischmetal Alloys | Steel | Desulphurisation | ~800 | 0.57–0.86 | ~0.1 |
| Ferroalloys: Fe-Si | Steel | Refining, Alloying and Deoxidation | 1210–1227 | 0.64 | 0.02 |
| Si-Mn | | | 1088–1216 | 0.80 | 0.015 |
| Fe-Mn | | | 1070–1220 | 1.0 | 0.018 |
| Any Powders etc. of Refining Agents Encased in an Al, Mg etc. Fast-Melting Bullet Shaped Shell | Steel | Alloying and Refining | — | <1 | — |
| $CaCO_3$, $MgCO_3$ etc. Powders in an Al, Mg etc. Shell | Steel | Bubbling, Melt Stirring | — | <1 | — |

The bands 4 may be made, for example, from:

(1) Papers (e.g. masking tape by D.R.G. Sellotape (Trade Mark), 3M (Trade Mark), Tuck (Trade Mark) etc.)

(2) Plastics (e.g. vinylidene chloride (Saran Wrap Trade Mark), polyethylene, polyvinylchloride, polytetrafluoroethylene, thermosetting plastics, Scotch Tape (Trade Mark), etc.)

(3) Refractories (e.g. Kyanex (Trade Mark) cement, etc.)

(4) Other organic materials (e.g. pitch, tar, rubber, etc.)

1. A melt dispersible, floatable solid additive projectile for molten metal, comprising:

a solid elongated body of the additive having a resist on a minor portion of a surface of the solid body with the remaining surface area of the solid body exposed for direct contact with the molten metal, the resist providing insulation between said body and said molten metal whereby a shell frozen from molten metal onto said body includes a region of retarded shell development corresponding to said resist.

2. A melt dispersible, floatable solid additive projectile for molten metal, comprising:

a solid elongated body of the additive having a resist up to substantially 16% of a surface of the solid body with the remaining surface area of the solid body exposed for direct contact with the molten metal, the resist providing insulation between said body and said molten metal whereby a shell frozen from molten metal onto said body includes a region of retarded shell development corresponding to said resist.

3. An additive as claimed in claim 2 in which the resist is in the form of two bands around the projectile.

4. An additive as claimed in claim 2 in which the resist is on substantially 4.5% of the solid body surface.

5. An additive as claimed in claim 4 in which the additive is in the form of a single band around the projectile.

6. An additive according to claim 1, wherein the resist is heat decomposable at the temperature of the molten metal.

7. An additive according to claim 1, wherein the resist is of a heat decomposable material that is gas evolving on exposure to the molten metal.

8. An additive according to claim 1, wherein the resist is in a slot in the solid, elongated body.

9. A method of melt dispersing a floatable, solid additive projectile in a molten metal ball, comprising:

(a) providing a resist on a surface of projectile to form local insulation between said projectile and said body, with the remaining surface area of the projectile exposed for direct contact with the molten metal, (b) projecting said projectile with said resist below the surface of molten metal ball, (c) permitting the formation of a frozen ball material shell to encase said projectile, the formation of said shell being retarded in the region of said resist, (d) melting at least a portion of the additive encased within the shell thereby forming an outlet from said shell in the region of said resist, (e) employing molten additive from said outlet, and (f) remelting the shell 10. A method according to claim 9, wherein the resist strip is heat decomposable at the temperature of the molten metal.

11. A method according to claim 9, wherein the resist strip is gas evolving at the temperature of the molten metal.

12. A method according to claim 9, wherein the resist strip is in a slot in the solid body of the additive.

* * * * *